US006041853A

United States Patent [19]

Edayoshi et al.

[11] Patent Number: 6,041,853

[45] Date of Patent: Mar. 28, 2000

[54] CEILING BUILT-IN TYPE AIR CONDITIONER

[75] Inventors: Atsushi Edayoshi; Hiroshi Nakashima; Osamu Kanaya; Ryo Oya; Eiji Fukushima, all of Tokyo, Japan

[73] Assignee: Mitsubishi Denki Kabushiki Kaisha, Tokyo, Japan

[21] Appl. No.: 09/106,849

[22] Filed: Jun. 30, 1998

[30] Foreign Application Priority Data

Jan. 30, 1998 [JP] Japan ..... 10-018674

[51] Int. Cl.[7] ..... F24H 3/06

[52] U.S. Cl. ..... 165/122; 165/135; 415/52.1; 415/119; 416/178; 416/187

[58] Field of Search ..... 165/122, 135; 415/52.1, 119; 181/198; 416/178, 187

[56] References Cited

U.S. PATENT DOCUMENTS

| | | | |
|---|---|---|---|
| 2,112,608 | 3/1938 | Schmidt | 415/119 |
| 2,437,452 | 3/1948 | Baird | 165/135 |
| 3,684,396 | 8/1972 | Ball et al. | 415/52.1 |
| 4,691,766 | 9/1987 | Wurz et al. | 165/135 |
| 5,336,046 | 8/1994 | Hashimoto et al. | 415/119 |
| 5,415,226 | 5/1995 | Koo . | |
| 5,449,271 | 9/1995 | Bushnell et al. | 415/119 |
| 5,536,140 | 7/1996 | Wagner et al. | 415/119 |
| 5,601,400 | 2/1997 | Kondo et al. | 415/119 |

FOREIGN PATENT DOCUMENTS

| | | | |
|---|---|---|---|
| 0 791 788 | 8/1997 | European Pat. Off. . | |
| 56-59148 | 5/1981 | Japan . | |
| 57-153916 | 6/1982 | Japan . | |
| 59-37274 | 2/1984 | Japan | 415/119 |
| 2-293547 | 12/1990 | Japan | 165/135 |
| 6-34156 | 2/1994 | Japan | 165/135 |
| 6307380 | 11/1994 | Japan | 415/119 |
| 1 403 278 | 8/1975 | United Kingdom . | |
| 2717612 | 11/1977 | United Kingdom | 415/119 |
| 2 095 752 | 10/1982 | United Kingdom . | |
| 3401-209 | 7/1985 | United Kingdom | 415/119 |
| 292-302 | 7/1991 | United Kingdom | 415/119 |

*Primary Examiner*—Ira S. Lazarus
*Assistant Examiner*—Terrell McKinnon
*Attorney, Agent, or Firm*—Oblon, Spivak, McClelland, Maier & Neustadt, P.C.

[57] ABSTRACT

The present invention aims at obtaining a ceiling built-in type air conditioner in which noise attributable to the breakaway flow of air at the front ends of the fins is decreased. For this purpose, the ceiling built-in type air conditioner has a heat exchanger 4 installed within a main body cabinet 1 having an air suction inlet 2 and an air blowing outlet 3 and has a centrifugal blower 7 installed in the air suction inlet 2. In this ceiling built-in type air conditioner, a flat-plate-shaped rectifying member 9 is placed near the middle point between the center of the air suction inlet 2 and the center of the heat exchanger 4 and is placed substantially at a right angle to the direction of the flow of air from the air suction inlet 2.

8 Claims, 9 Drawing Sheets

CEILING BUILT-IN TYPE AIR CONDITIONER

BACKGROUND OF THE INVENTION

The present invention relates to a ceiling built-in type air conditioner having a heat exchanger installed within a main body cabinet including an air suction inlet and an air blowing outlet.

FIG. 13 is a perspective view for showing a conventional ceiling built-in type air conditioner, and FIG. 14 is a transverse cross-sectional view thereof. In these drawings, 1 denotes a main body cabinet for forming an outer fence of the air conditioner, and this has an air suction inlet 2 and an air blowing outlet 3. 4 denotes a fin tube heat exchanger incorporated in the main body cabinet 1, and fins 5 of the heat exchanger 4 are vertically arranged in parallel with the flow of air within the main body cabinet 1. 6 denotes a casing provided outside the air suction inlet 2 of the main body cabinet 1, and an air blowing outlet of the casing 6 has a smaller area than that of an air suction surface in the front of the heat exchanger 4. 7 denotes a centriffigal blower provided inside the casing 6 and the length (width) of the centrifugal blower 7 in the axial direction is smaller than the length (width) of the heat exchanger 4. Further, 8 denotes a blower motor for driving the centrifugal blower 7.

Next, the flow of air of the prior-art ceiling built-in type air conditioner will be explained with reference to FIG. 15, FIG. 16 and FIG. 17. As shown in FIG. 15 and FIG. 16, the air entering the main body cabinet through the air suction inlet 2 from the casing 6 by the rotation of the centrifugal blower 7 generates a straight flow A which blows against the heat exchanger 4 at a right angle, a convective flow B which is generated at the upper, lower, left and right sides of the straight flow, and a parallel flow C which flows immediately before the heat exchanger 4 along the air suction surface of the heat exchanger 4.

FIG. 17 shows the flow immediately before the heat exchanger 4, and the parallel flow C which flows along the air suction surface of the heat exchanger 4 breaks away at the front ends of the fins 5 of the heat exchanger 4 and many breakaway flows D are further generated.

Since the prior-art ceiling built-in type air conditioner is structured as described above, noise like piping sound is generated due to the convective flow B, the parallel flow C and the breakaway flows D. We have confirmed that at the generated frequency of about 2 to 5 kHz, this noise becomes larger in proportion to the flow velocity of the passing air.

Further, the level of the noise changes depending on the distance between the heat exchanger and the air blowing outlet of the centrifugal blower casing, the size of the heat exchanger and the size of the air blowing outlet of the centrifugal blower casing. The noise of this type has become an increasing problem of abnormal noise under the environment of a higher demand for reducing noise of air conditioners and other noises in rooms.

Under these circumstances, as techniques for decreasing noise generated by the flow of blowing air from the fan to the heat exchanger, there have been disclosed a technique of providing a rectifying piece between the fan and the heat exchanger in Japanese Utility Model Application Laid-open (JP-U) No. 57-153916 and a technique of providing a rectifying plate in the air blowing outlet section of the fan in the Japanese Patent Application Laid-open (JP-A) No. 56-59148 respectively. However, according to the invention of the Japanese Utility Model Application Laidopen (JP-Th No. 57-153916, air is distributed properly into a heat exchanger coil by employing an oval or wing-shaped rectifying piece, and according to the invention of the Japanese Patent Application Laid-open (JP-A) No. 56-59148, a rectifying plate is provided at the air blowing outlet section of the fan. None of these inventions have the same structure and effects as the present invention.

SUMMARY OF THE INVENTION

With a view to eliminating the above-described problems, it is an object of the present invention to provide a ceiling built-in type air conditioner in which noise attributable to the breakaway flows of air at the front ends of the fins is reduced.

The present invention provides an air conditioner having a heat exchanger installed within a main body cabinet having an air suction inlet and an air blowing outlet, and having a centrifugal blower installed at the air suction inlet, wherein a flat-plate-shaped rectifying member is placed at a position near the middle point between the center of the air suction inlet in the vertical direction and the center of the air suction surface of the heat exchanger in the vertical direction, and is placed substantially at a right angle to the direction of the flow of air from the air suction inlet. According to this arrangement, it becomes possible to deflect the air blown out by the centrifugal blower, reduce the speed of the flow of the air reaching the heat exchanger, mitigate a parallel flow generated to flow along an air suction surface of the heat exchanger, and reduce the generation of noise due to the breakaway flows generated at front ends of the fins of the exchanger.

Further, a projection portion for reinforcement is formed at the heat exchanger side of the rectifying member. This has an effect of improving the strength of the rectifying member and thus suppressing the deformation and vibration of the rectifying member due to the fluid force.

Further, a ceiling built-in type air conditioner of the present invention has the rectifying member installed on the main body cabinet so as to be supported by both side panels of the main body cabinet. With this arrangement, the number of parts necessary for the installation of the rectifying member can be minimized, and the installation is also facilitated.

Further, a ceiling built-in type air conditioner of the present invention has the rectifying member installed on a ceiling panel of the main body cabinet via supporting members. With this arrangement, the material for the rectifying member can be saved and the installation of the rectifying member is also simplified.

Further, a ceiling built-in type air conditioner of the present invention has the rectifying member installed on a panel on the air suction inlet side of the main body cabinet, via supporting legs. With this arrangement, the shape of the supporting legs can be simplified and their installation is also facilitated.

DETAILED DESCRIPTION OF THE PREFERRED EMBODIMENTS

First Embodiment

Figure 1:
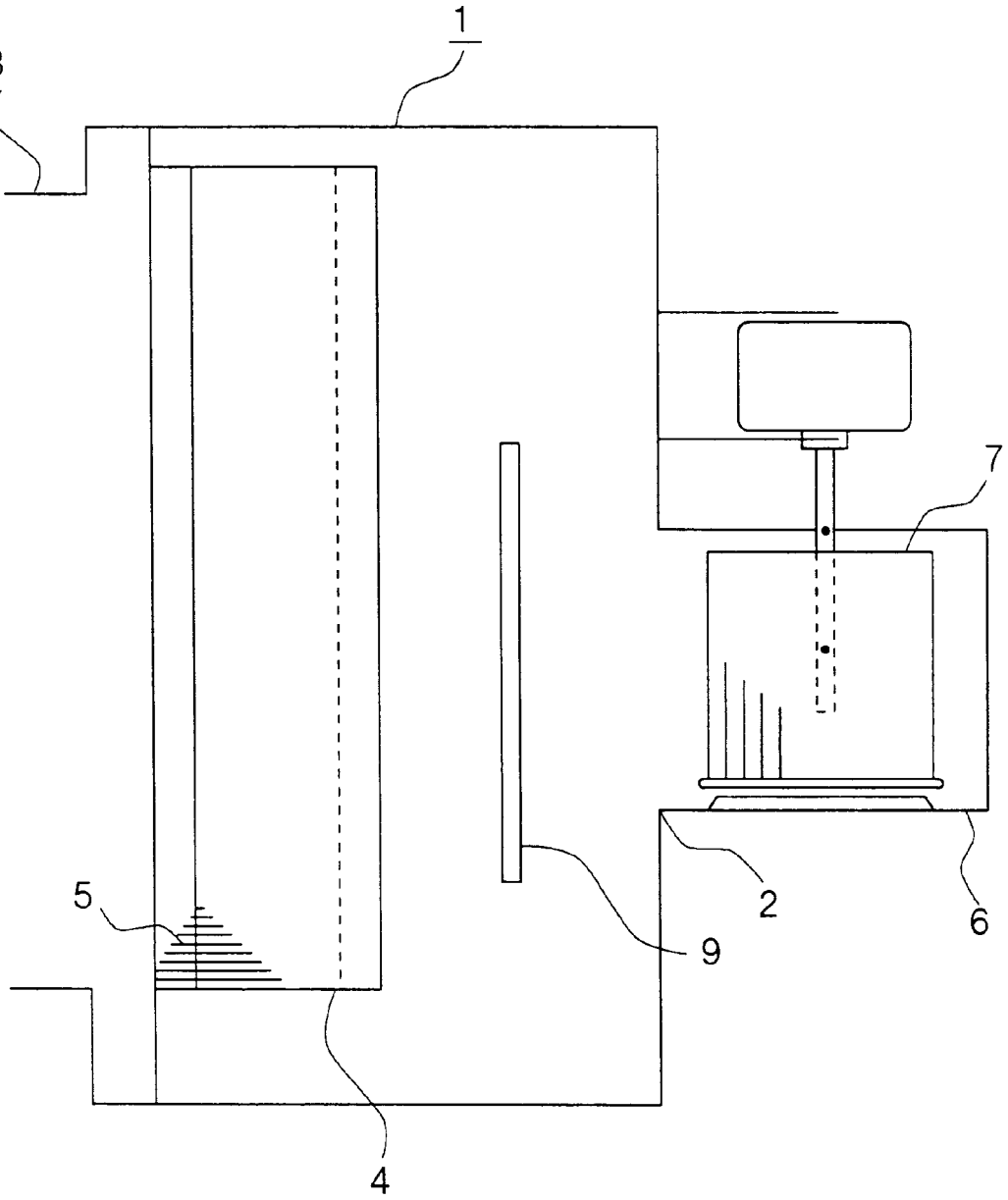
FIG. 1 is a top plan view of a ceiling built-in type air conditioner for showing a first embodiment of the present invention.
Figure 2:
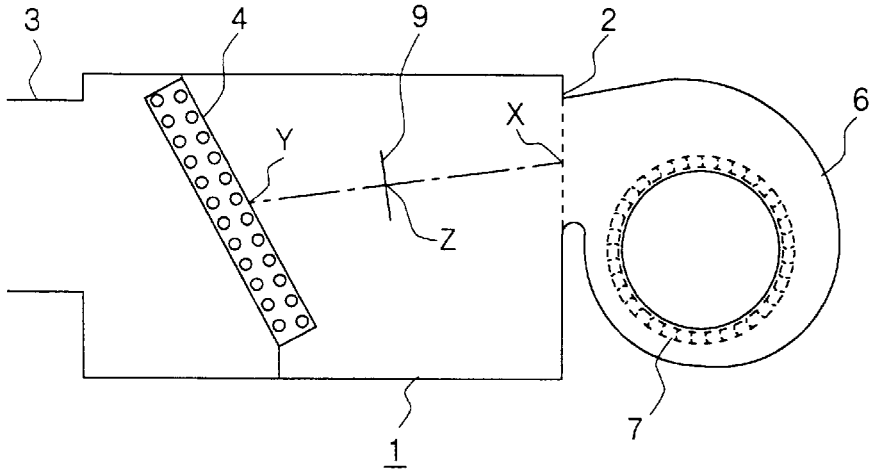
FIG. 2 is a transverse cross-sectional view of the ceiling built-in type air conditioner for showing the first embodiment of the present invention.

A first embodiment of the present invention will be explained with reference to FIGS. 1 to 5. Referring to FIG. 1 and FIG. 2, 1 denotes a main body cabinet for forming an outer fence of a ceiling built-in type air conditioner, and the main body cabinet has an air suction inlet 2 and an air blowing outlet 3. 4 denotes a fin tube heat exchanger incorporated in the main body cabinet 1, and fins 5 of the heat exchanger 4 are vertically arranged in parallel with the flow of air within the main body cabinet 1. 6 denotes a casing provided outside the air suction inlet 2 of the main body cabinet 1, and according to the present invention, an air blowing outlet of the casing 6 corresponds to the air suction inlet 2 of the main cabinet 1. The air blowing outlet of the casing 6 has a smaller area than that of an air suction surface in the front of the heat exchanger 4. 7 denotes a centrifugal blower provided inside the casing 6 and the length (width) of the centrifugal blower 7 in the axial direction is smaller than the length (width) of the heat exchanger 4. Further, 8 denotes a blower motor for driving the centrifugal blower 7.

9 denotes a flat-plate-shaped rectifying member provided between the air suction inlet 2 of the cabinet 1 and the heat exchanger 4. The rectifying member 9 is placed at a position near the middle Z between the middle X of the air suction inlet 2 of the main body cabinet 1 in the vertical direction and the middle Y of the air suction surface of the heat exchanger 4 in the vertical direction, and is placed at right angles to the direction of the flow of air blown out from the centrifugal blower 7. Although the size of the rectifying member 9 changes depending on the level of noise generated, it is effective to set its length (long side) to be equal to or longer than the length (width) of the centrifugal blower 7 in the axial direction and to set the height (short side) to be about 10% to 60% of the width of the casing 6 of the centrifugal blower 7.

Figure 3:
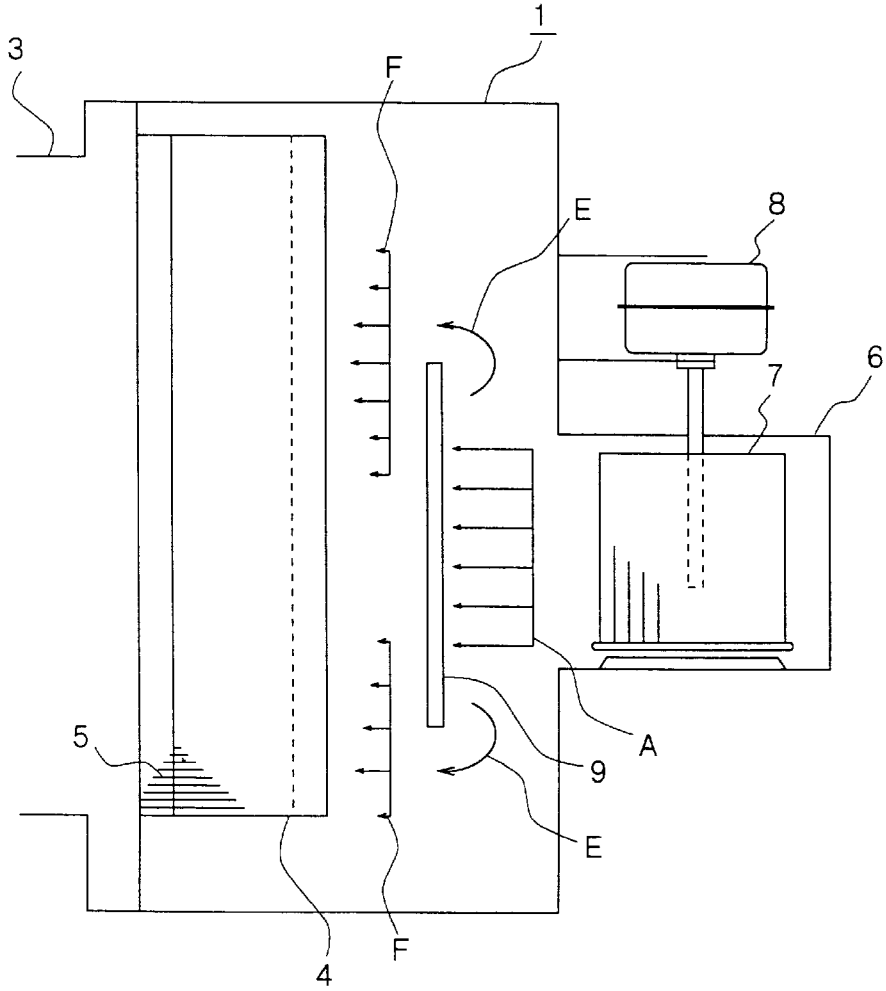
FIG. 3 is a wind velocity distribution diagram observed in the top plan view of the ceiling built-in type air conditioner for showing the first embodiment of the present invention.
Figure 4:
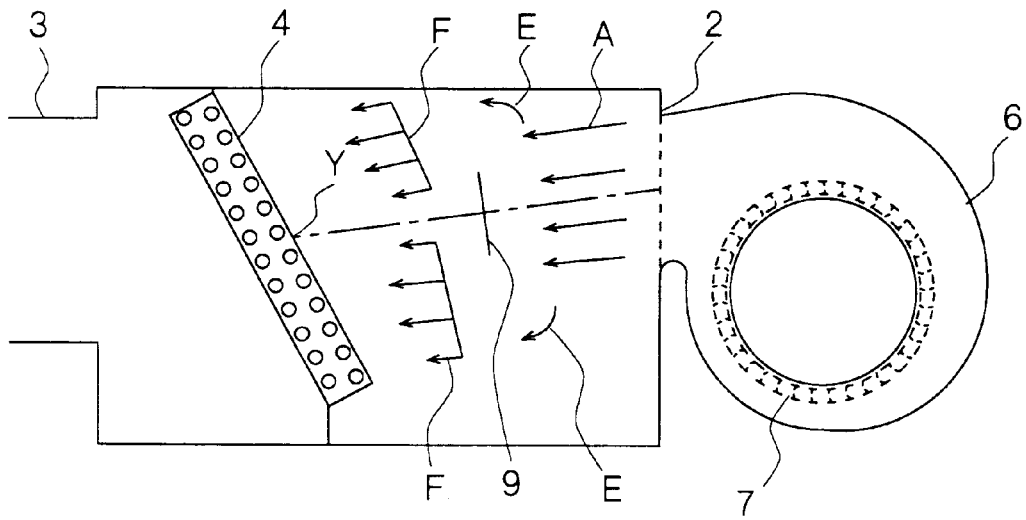
FIG. 4 is a wind velocity distribution diagram observed in the transverse cross-sectional view of the ceiling built-in type air conditioner for showing the first embodiment of the present invention.
Figure 5:
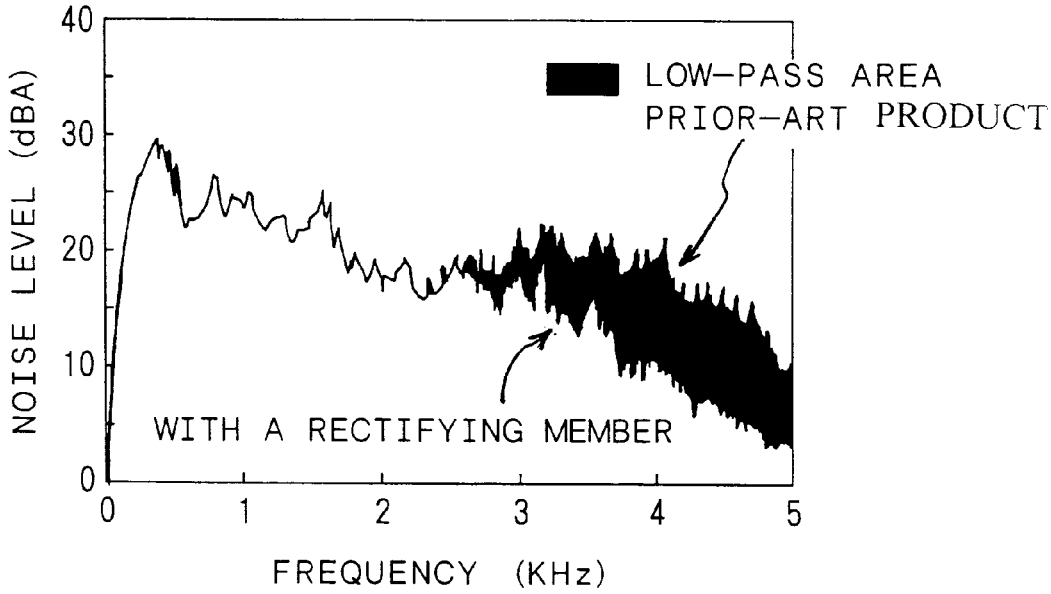
FIG. 5 is a noise value comparison diagram for showing the comparison between the ceiling built-in type air conditioner for showing the first embodiment of the present invention and a prior-art air conditioner.

The flow of the air according to this structure will be explained next with reference to FIG. 3 and FIG. 4. The air flow taken into the main body cabinet 1 from the air suction inlet 2 by the centrifugal blower 7 collides against the rectifying member 9 and thereafter becomes a round-about flow E to flow so as to detour around the rectifying member 9. Further, a straight air flow A becomes a diffusion flow F immediately before the heat exchanger 4 so that distribution of the air flow is more diffused than that according to the prior-art techniques and flow velocity of the air flow immediately before the heat exchanger 4 is lowered. As a result, a parallel component of the air flow along the air suction surface of the heat exchanger 4 is decreased and breakaway flows of the air generated at the front ends of the fins 5 become smaller. Accordingly, the noise of 2 to 5 kHz is decreased as shown in FIG. 5.

Second Embodiment

Figure 6:
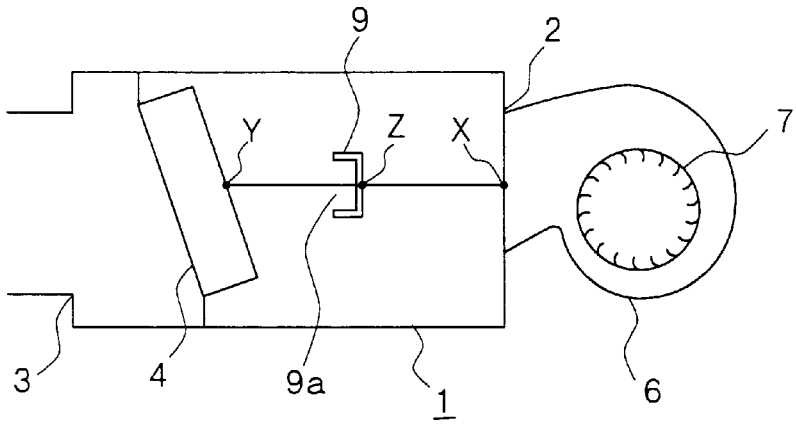
FIG. 6 is a transverse cross-sectional view of a ceiling built-in type air conditioner for showing a second embodiment of the present invention.

In this case, the strength of the rectifying member 9 is improved by forming a projection portion for reinforcement, projecting toward the heat exchanger 4, in the rectifying member 9. For example, as shown in FIG. 6, the upper and lower ends of the rectifying member 9 are bent back toward the heat exchanger 4. With this arrangement, the strength of the rectifying member 9 can be improved and the rectifying member is prevented from being deformed. This is suitable particularly when a metal such as iron or aluminum is used for the rectifying member 9. The rectifying member 9 may also be formed with a projection portion to have a cross-sectional shape of other forms such as an L-shape, T-shape and H-shape. However, in any case, the flat-plate plane is to be faced to the direction of the centrifugal blower 7.

Third Embodiment

Figure 7:
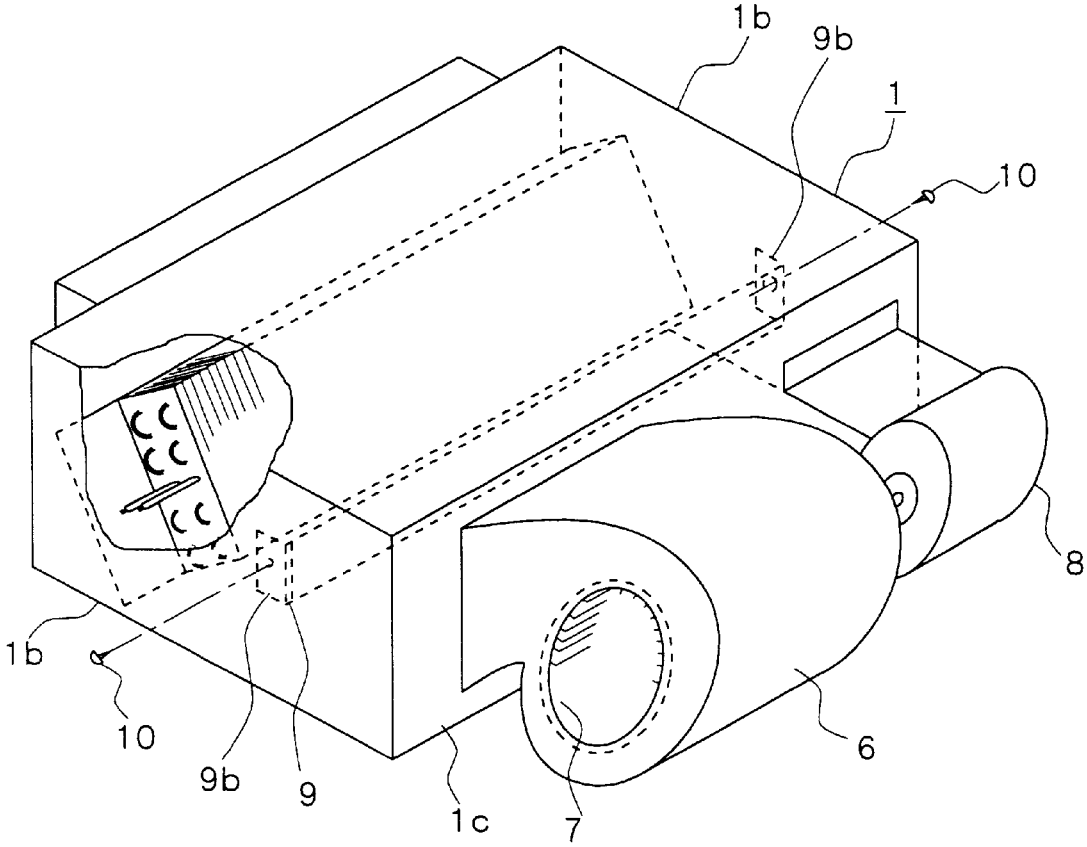
FIG. 7 is a perspective view of a ceiling built-in type air conditioner for showing a third embodiment of the present invention.
Figure 8:
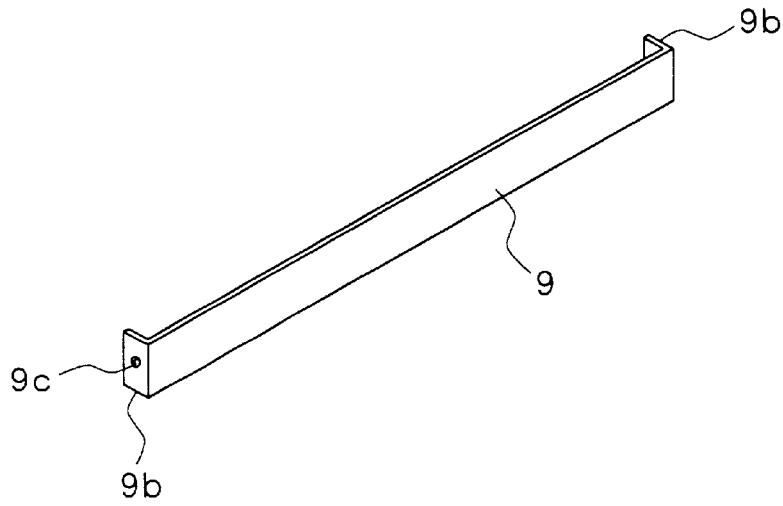
FIG. 8 is a perspective view of a rectifying member in the third embodiment of the present invention.

In this case, a first example of the method of installing the rectifying member 9 will be explained. As shown in FIG. 8, the rectifying member 9 has its length (width) substantially the same as the width of the main body cabinet 1, and has a flange **9*b* with a screw hole 9*c* at each of both ends of the rectifying member. This rectifying member 9 is fixed to inside of both side panels 1*b* of the main body cabinet 1 with screws 10 or the like, as shown in FIG. 7. With this arrangement, the rectifying member 9 can be made in a simple shape, and the rectifying member 9** can be installed easily.

Fourth Embodiment

Figure 9:
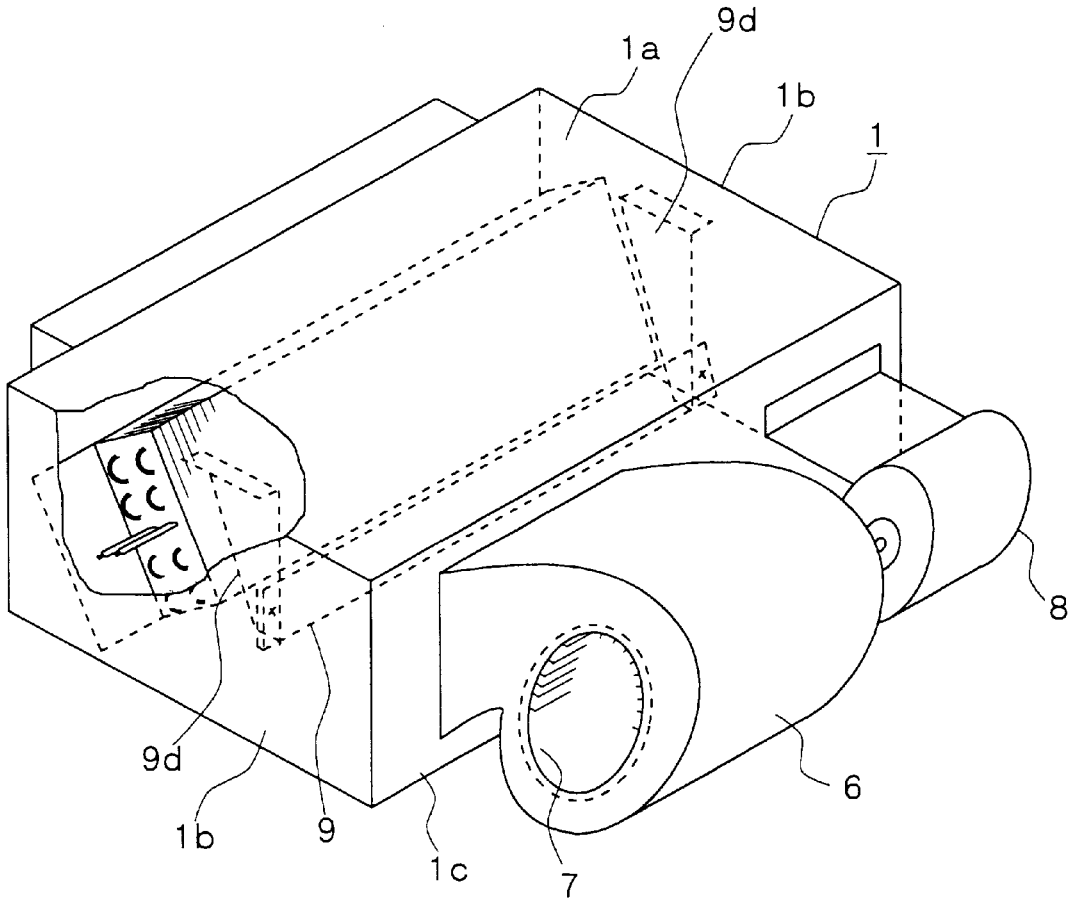
FIG. 9 is a perspective view of a ceiling built-in type air conditioner for showing a fourth embodiment of the present invention.
Figure 10:
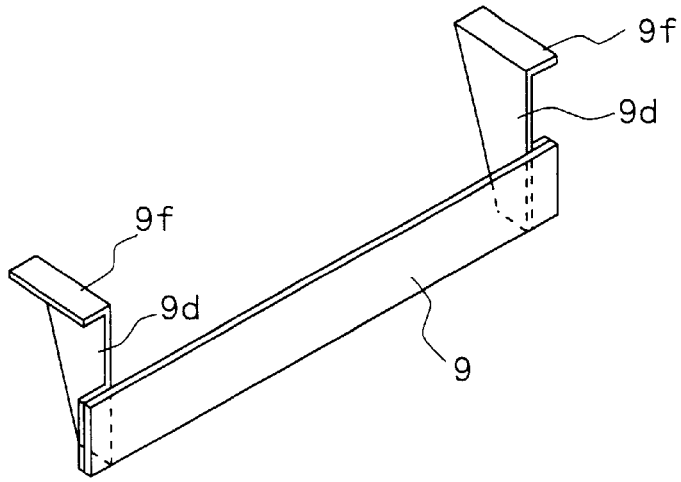
FIG. 10 is a perspective view of a rectifying member in the fourth embodiment of the present invention.

Next, a second example of the method of installing the rectifying member 9 will be explained. As shown in FIG. 10, the rectifying member 9 has a supporting member **9*d* on each of its both ends, with a flange 9*f* formed on the top end of each supporting member 9*d*. This rectifying member 9 is fixed to a ceiling panel 1 a of the main body cabinet 1 by utilizing their flanges 9*f* by welding or by screws or the like, as shown in FIG. 9. The supporting members 9*d* may be integrally molded with the rectifying member 9 or may be mounted on the rectifying member 9** by welding or the like.

Fifth Embodiment

Figure 11:
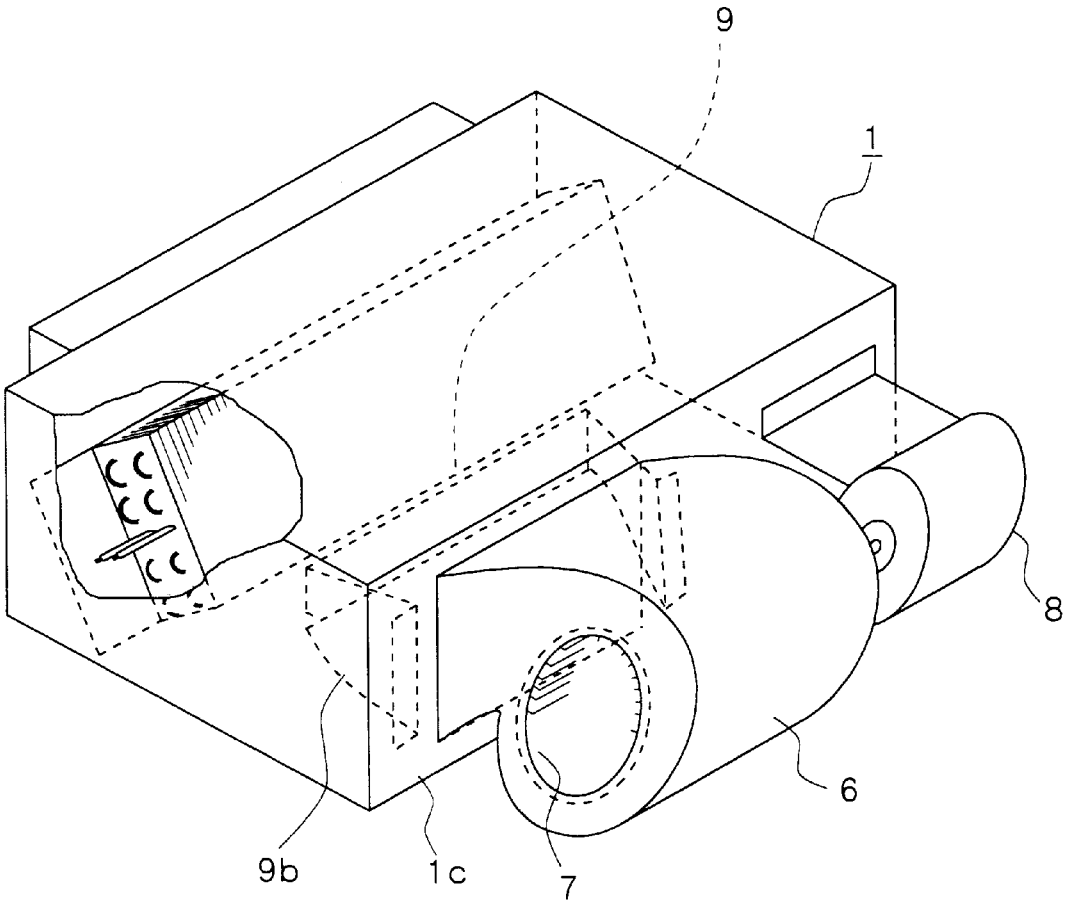
FIG. 11 is a perspective view of a ceiling built-in type air conditioner for showing a fifth embodiment of the present invention.
Figure 12:
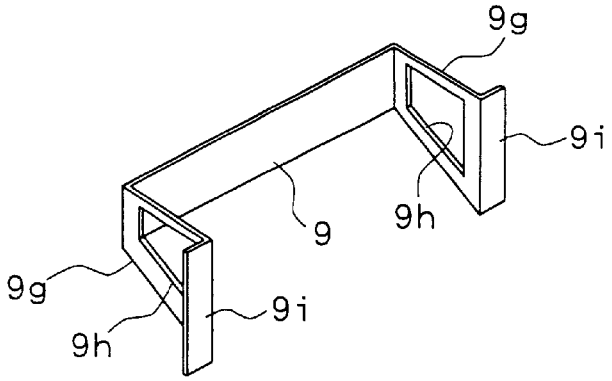
FIG. 12 is a perspective view of a rectifying member in the fifth embodiment of the present invention.
Figure 13:
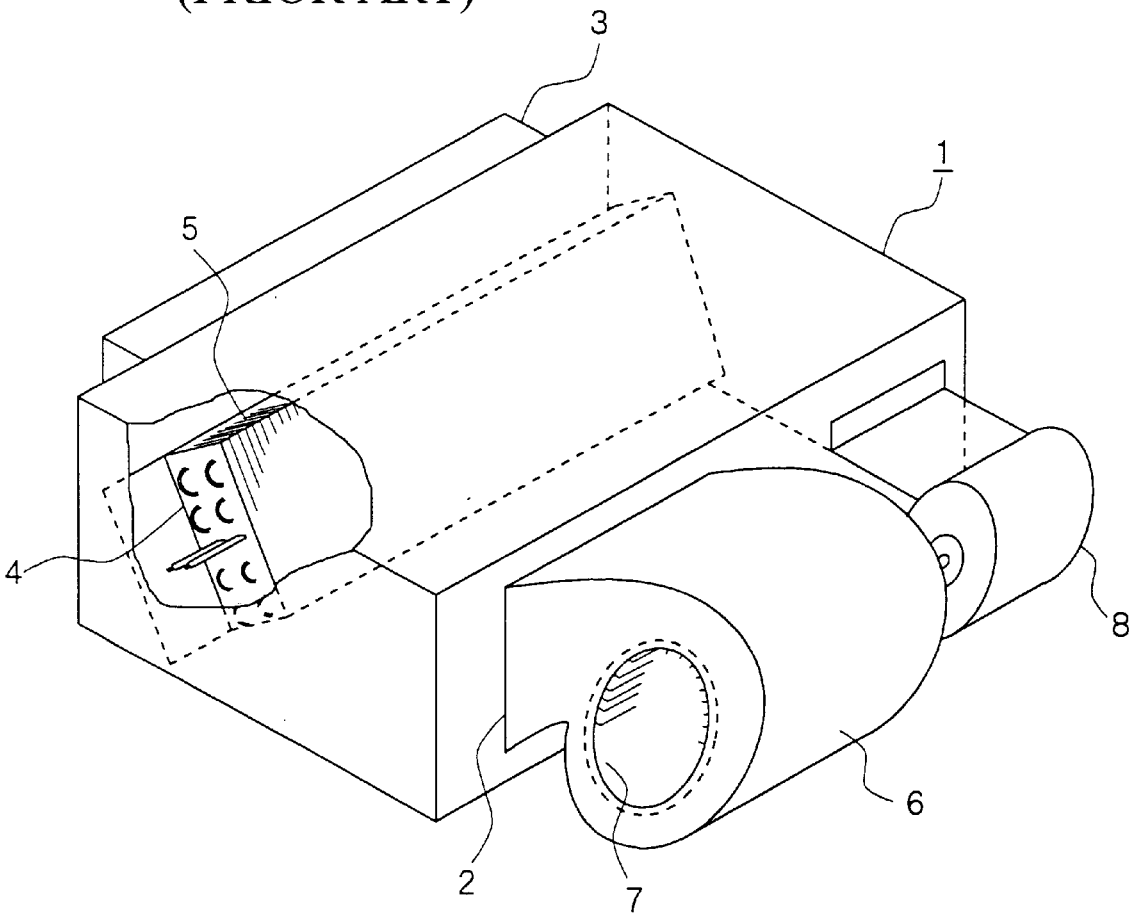
FIG. 13 (PRIOR ART)
FIG. 13 is a perspective view of a prior-art ceiling built-in type air conditioner.
Figure 14:
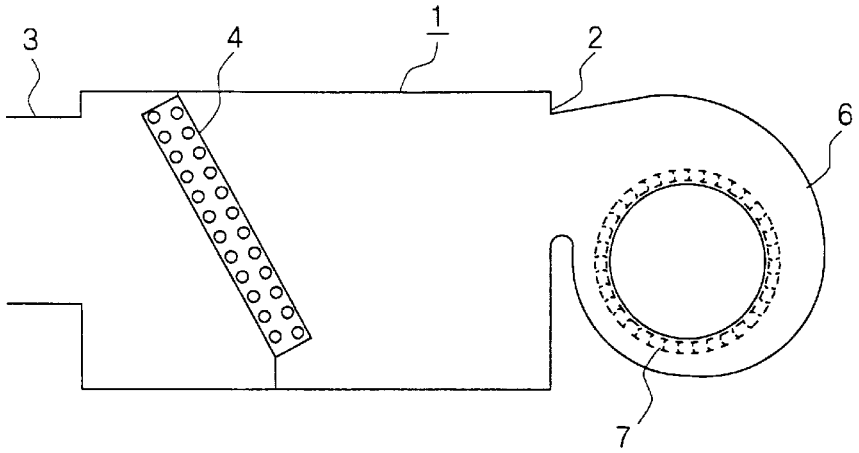
FIG. 14 (PRIOR ART)
FIG. 14 is a transverse cross-sectional view of the prior-art ceiling built-in type air conditioner.
Figure 15:
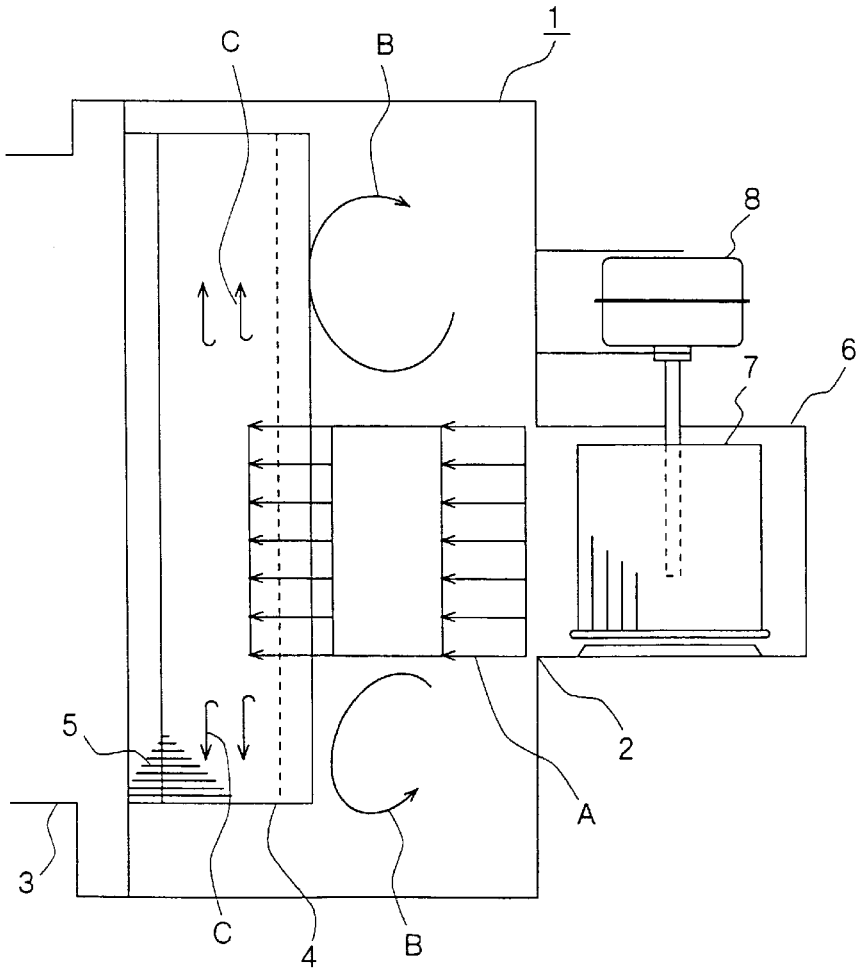
FIG. 15 (PRIOR ART)
FIG. 15 is a wind distribution diagram observed in a top plan view of the prior-art ceiling built-in type air conditioner.
Figure 16:
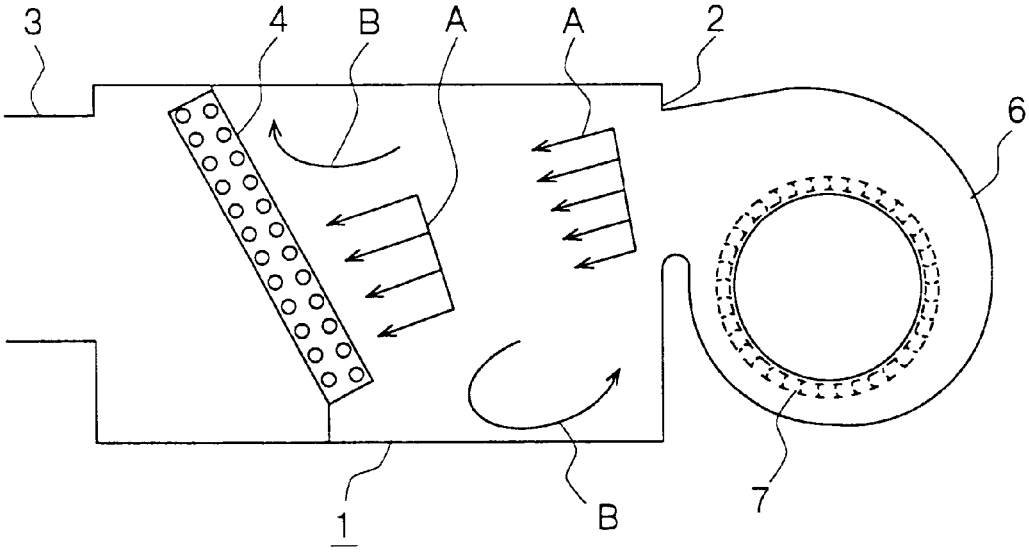
FIG. 16 (PRIOR ART)
FIG. 16 is a wind distribution diagram observed transverse cross-sectional view of the prior-art ceiling built-in type air conditioner.
Figure 17:
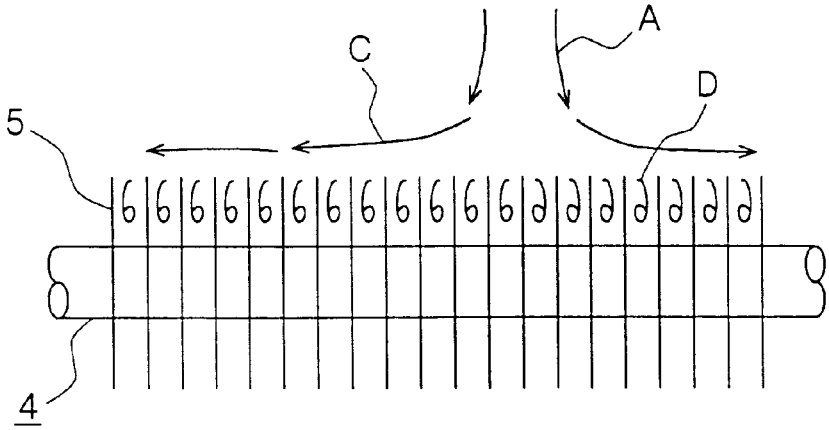
FIG. 17 (PRIOR ART)
FIG. 17 is a wind distribution diagram of a heat exchanger section of the prior-art ceiling built-in type air conditioner.

Further, a third example of the method of fitting the rectifying member 9 will be explained. As shown in FIG. 12, the rectifying member 9 has a supporting leg 9*g* bent-formed at each of both ends of the rectifying member by an integral molding or the like. Further, each supporting leg 9*g* has a flange 9*i* formed at its end, and a draft opening 9*h* for the round-about air flow E formed at the center portion of the supporting leg. This rectifying member 9 is fixed to a panel 1*c* on the air suction inlet side of the main body cabinet 1 by utilizing the flanges 9*i* by welding or by screws or the like, as shown in FIG. 11. With this arrangement, the rectifying member 9 can be made in a simple shape, and the rectifying member 9 can be installed easily.

What is claimed is:

1. A ceiling built-in type air conditioner having a heat exchanger installed within a main body cabinet having an air suction inlet and air blowing outlet, and having centrifugal wear installed at said air suction inlet, wherein a flat-plate-shaped rectifying member is placed at a position near the middle between the center of said air suction inlet and the center of an air suction surface of said heat exchanger, and is placed substantially at a right angle to the direction of the flow of air from said air suction inlet, wherein the length of said rectifying member is set longer than the width of said centrifugal blower.

2. A ceiling built-in type air conditioner according to claim 1, wherein said rectifying member is installed on both side panels of said main body cabinet.

3. A ceiling built-in type air conditioner having a heat exchange installed within a main body cabinet having an air suction inlet and an air blowing outlet, and having a centrifugal blower installed at said air suction inlet, wherein a flat-plate-shaped rectifying member is placed at a position near the middle between the center of said air suction inlet and the center of an air suction surface of said heat exchanger, and is placed substantially at a right angle to the direction of the flow of air from said air suction inlet, wherein a projection portion for reinforcement, projecting toward said heat exchanger, is formed in said rectifying member.

4. A ceiling built-in type air conditioner according to claim 3, wherein said projection portion of said rectifying member is formed by bending the upper and lower ends of said rectifying member toward said heat exchanger.

5. A ceiling built-in type air conditioner having a beat exchanger installed within a main body cabinet having an air suction inlet and an air blowing outlet, and having a centrifugal blower installed at said air suction inlet, wherein a flat-plate-shaped rectifying member is placed at a position near the middle between the center of said air suction inlet and the center of an air suction surface of said heat exchanger, and is placed substantially at a right angle to the direction of the flow of air from said air suction inlet, wherein said rectifying member is installed on a ceiling panel of said main body cabinet via supporting members.

6. A ceiling built-in type air conditioner having a heat exchanger installed within a main body cabinet having an air suction inlet and an air blowing outlet, and having a centrifugal blower installed at said air suction inlet, wherein a flat-plate-shaped rectifying member is placed at a position near the middle between the center of said air suction inlet and the center of an air suction surface of a said heat exchanger, and is placed substantially at a right angle the direction of the flow of air from said air suction inlet, wherein said rectifying member is installed on a front panel on said air suction inlet side of said main body cabinet supporting legs.

7. A built-in ceiling air conditioner, comprising:

a main body cabinet including an air suction inlet and an air blowing outlet;

a heat exchanger installed within the main body cabinet;

a centrifugal blower installed outside the air suction inlet relative to the heat exchanger; and a substantially planar rectifying member oriented substantially perpendicular to a direction of a flow of air from the air suction inlet and located between the air suction inlet and the heat exchanger.

8. A built-in ceiling air conditioner according to claim 7, wherein:

the rectifying member is located in between the air suction inlet and the heat exchanger in a position near the midpoint between the center of the air suction inlet and the center of an air suction surface of the heat exchanger.

* * * * *